US005384949A

United States Patent [19]

Wodrich et al.

[11] Patent Number: 5,384,949

[45] Date of Patent: Jan. 31, 1995

[54] TORQUE TRANSMITTING STRUCTURE AND METHOD OF MANUFACTURE

[75] Inventors: Helmut A. H. Wodrich, Canton, Mich.; Mario S. Zanet, Windsor, Canada

[73] Assignee: General Motors Corporation, Detroit, Mich.

[21] Appl. No.: 168,335

[22] Filed: Dec. 17, 1993

Related U.S. Application Data

[63] Continuation of Ser. No. 766, Jan. 5, 1993, abandoned.

[51] Int. Cl.[6] ..... B21D 22/18

[52] U.S. Cl. ..... 29/557; 72/84; 192/70.2

[58] Field of Search ..... 72/82, 83, 84, 208; 192/70.19, 70.2; 29/557

[56] References Cited

U.S. PATENT DOCUMENTS

| | | | |
|---|---|---|---|
| 3,120,206 | 2/1964 | Sporck | 72/208 X |
| 3,924,434 | 12/1975 | Fulier | 72/208 |
| 3,937,047 | 2/1976 | Saunders | 72/208 X |
| 4,440,282 | 4/1984 | Ishinaru et al. | 192/70.2 |
| 4,566,571 | 1/1986 | Fujioka | 192/70.19 X |
| 5,016,460 | 5/1991 | England et al. | 72/208 |

*Primary Examiner*—Joseph M. Gorski
*Attorney, Agent, or Firm*—Donald F. Scherer

[57] ABSTRACT

A torque transmitting structure for an automatic transmission has an inner hub for rotating the structure and an outer annular shell. The annular shell has an internal radial spline portion, an external brake surface, a torque tube and an axially facing drive connecting surface. The annular shell is manufactured in a flow forming process, wherein a cup-shaped blank is secured on a mandrel which has a shape complementary to the internal shape of the shell. Forming rolls engage the outer surface and are moved axially relative to the mandrel in a manner to form the desired outer contour of the shell. After the flow forming operation, the shell is removed from the mandrel, the axial drive connection is formed by metal removal and the hub is bonded to the shell.

2 Claims, 2 Drawing Sheets

TORQUE TRANSMITTING STRUCTURE AND METHOD OF MANUFACTURE

This is a continuation of application Ser. No. 08/000,766 filed on Jan. 5, 1993, now abandoned.

TECHNICAL FIELD

This invention relates to torque transmitting members and methods of manufacturing. More particularly, this invention relates to tubular torque transmitting members having axial and radial spline portions and the flow forming manufacture thereof.

BACKGROUND OF THE INVENTION

Flow forming of transmission components, such as clutch housings, is being introduced into the manufacturing process. The current use of this manufacturing form is to provide a tubular shell from a disc member. The internal drive spline teeth are roll formed and the outer diameter is smooth and of singular dimension. At least one process considers forming spline teeth in the outer diameter using a toothed tool member to press the tooth form into the outer diameter after the flow forming operation.

The more common manufacturing processes used in the manufacture of clutch housings is deep drawing, which is a multiple step process or hammer forming, wherein a hammer like tool is used to form a cup-shaped blank formed on a toothed mandrel. Axial roll forming has also been used to manufacture these components. With this process, a cup-shaped blank is mounted on a shaped mandrel, and a roll formed tool moves axially to press the metal to the tooth shape on the mandrel, essentially one tooth at a time. The mandrel is rotated to present the undeveloped surface to the roll form too to allow the entire inner surface to be splined.

The prior art structures have been limited to simple housings while more intricate assemblies, such as a torque tube drive connection in clutch housings used in one commercially available transmission, continue to be multiple piece structures.

SUMMARY OF THE INVENTION

It is an object of the present invention to provide a new method of manufacture of a torque transmitting housing having an internal radial spline, a brake surface circumjacent the internal spline, a torque transmitting tube portion and an axially extending drive portion.

It is another object of this invention to provide a torque transmitting housing and method of manufacture thereof, wherein a cup-shaped blank is mounted on a shaped mandrel to be flow formed by a plurality of forming rollers which are translated axially relative to the rotating mandrel to provide a smooth outer surface for a predetermined length of the body and a splined inner surface for that predetermined length, further flow forming provides a thickening of a wall portion to increase the outer diameter of the body, and further flow forming provides a third portion of a second predetermined thickness less than the first predetermined thickness, and a final flow forming of a fourth portion of a body to a predetermined thickness greater than the third body portion by increasing at least the outer diameter of the body.

It is still another object of this invention to provide a torque transmitting housing and the process of making the same, as previously described, wherein the torque transmitting housing after a flow forming operation is removed from the machine tool to permit the removal of portions of the fourth portion of the body therein providing an axial drive connection for the torque transmitting housing.

It is yet another object of this invention to provide an improved torque transmitting housing and method of manufacture thereof, as previously described, wherein a flow formed housing having axially extending drive tabs is bonded to a hub member for rotatably supporting the torque transmitting housing in a transmission.

These and other objects and advantages of the present invention will be more readily apparent from the following description and drawings.

DESCRIPTION OF AN EXEMPLARY EMBODIMENT

Figure 1:
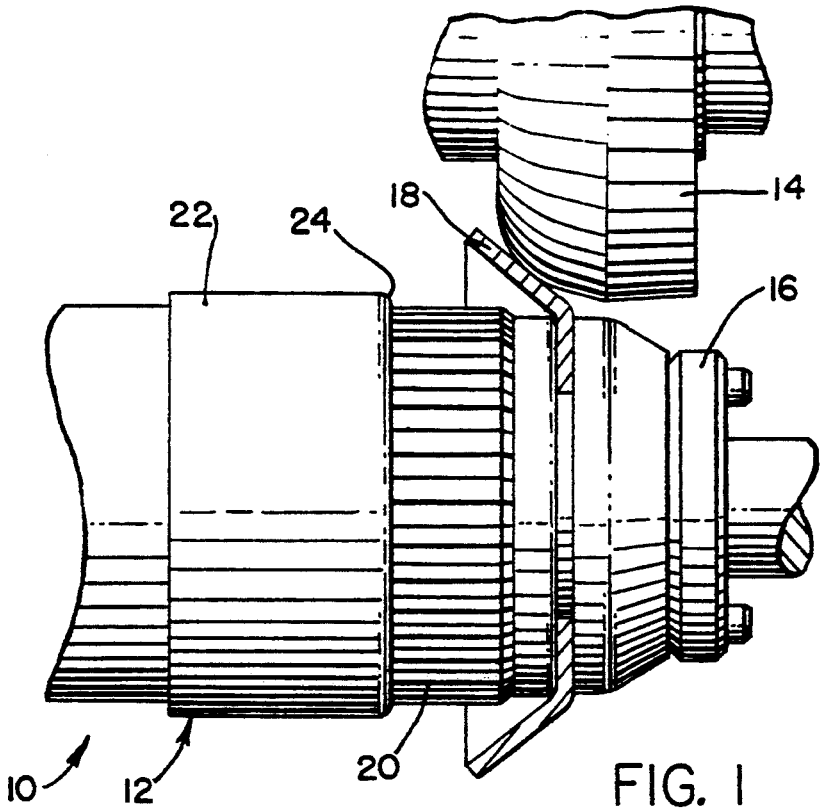
FIG. 1 is a diagrammatic representation of a cup-shaped blank that is secured to a rotating mandrel and positioned relative to one or more roll forming members.
Figure 2:
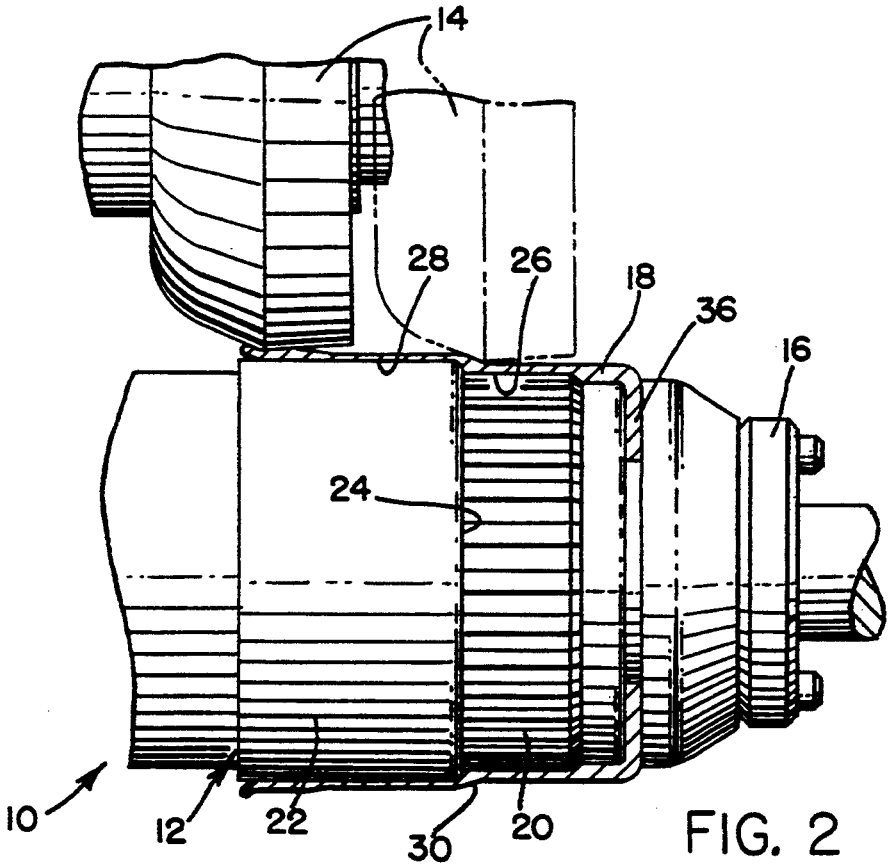
FIG. 2 is a view similar to FIG. 1 showing the roll forming member having moved axially along the mandrel to provide the desired inner and outer shape of the transmission housing.

Referring to the drawings, wherein like characters represent the same or corresponding parts throughout the several views, there is seen in FIGS. 1 and 2, a diagrammatic representation of a machine tool 10 comprised of a rotating or rotatable mandrel 12 and at least one axially movable forming roller or head 14. The mandrel 12 has a tail stock and clamp 16 which is effective to position a cup-shaped blank 18 on the end of the mandrel 12.

The mandrel 12 has a shaped outer contour which defines a spline portion 20 and a smooth bore 22. The smooth bore 22 and the spline portion 20 are separated by a step portion 24 which provides an increased diameter between the outer edge of the spline portion 20 and the smooth bore 22.

When the cup-shaped blank 18 is secured in place on the mandrel 12 by the tail stock and clamp 16, the forming roller or head 14 is extended axially along the outer surface of the cup-shaped blank 18 to enforce flow forming of the metal within the cup-shaped blank 18. With the flow forming process, the metal in the cup-shaped blank 18 will conform to the outer surface of the mandrel 12. That is, the inner surface of the cup-shaped blank 18 will form an inner spline portion 26 which is complementary to the spline portion 20, and a smooth inner diameter 28 which is complementary to the smooth bore portion 22.

The forming head 14 is translated axially along the length of the mandrel 12, as previously explained. The rolling forming head 14 moves linearly along the spline portion 20 and is then moved radially outward while continuing to flow form the cup-shaped blank 18 to establish an increase in blank thickness as the mandrel length is traversed to permit the increased diameter of a smooth inner bore surface 22 to be accommodated.

Figure 4:
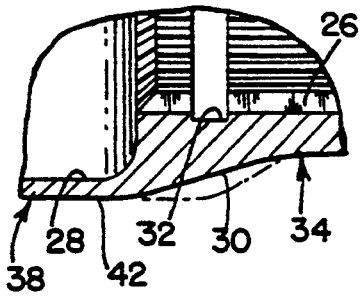
FIG. 4 is an enlarged view of a portion of FIG. 3.

As seen in FIGS. 2 and 4, the blank 18 undergoes a significant increase in outer diameter between the spline portion 26 and the smooth inner diameter portion 28. This diameter increase is preferably a continuous taper 30, however, the angle of the taper can vary as shown by the phantom line in FIG. 4. The increased wall thickness at this position provides for an area in which a groove 32 can be machined following the removal of the blank from the mandrel 12.

The groove 32, as is well known, will accommodate a locking ring (not shown) which will hold in place or otherwise axially position a plurality of clutch plates and backing plates which are disposed in the spline portion 26 of a clutch housing or torque transmitting tube 34 when a transmission assembly is completed.

Figure 3:
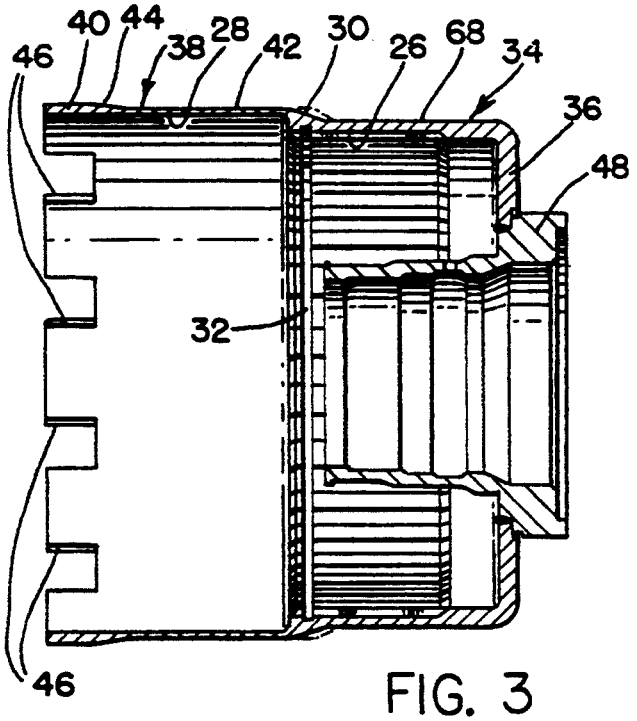
FIG. 3 is a sectional view of a transmission housing constructed in accordance with the present invention.

The cup-shaped blank 18, following the flow forming process, will provide the torque transmitting tube 34, as shown in FIG. 3. The outer axially extending shell of the torque transmitting tube 34 is formed entirely by the forming heads 14 and the complementary surfaces on the mandrel 12. The radially end wall 36 of the torque tube 34 is formed in a drawing process which was performed to provide the cup-shaped blank 18 prior to assembly on the mandrel 12.

As seen in FIG. 4, the torque transmitting tube 34 is comprised of the spline portion 26, the taper portion 30 which separates the spline portion 26 from the torque tube portion 38. The torque tube portion 38 is formed along the torque transmitting tube 34 between the taper 30 and an axial torque transmitting portion 40. The torque tube portion 38 is a thin walled portion having a smooth inner diameter 28 and a constant outer diameter 42.

During the forming process, the outer wall of the torque transmitting tube 34 is expanded at 44 to provide an increased wall thickness for the axial drive portion 40. After the torque transmitting tube 34 has been removed from the mandrel 12 by conventional stripping apparatus, the axial drive portion 40 is formed in the end of the torque transmitting tube 34 by removing material with a conventional metal cutting process as shown at axial teeth 46. This plurality of axially extending teeth is a well known manner in which a torque tube can be connected to a gear element or other hub member within a transmission. In the prior art, however, the tube would have drive connecting teeth at both ends.

Also following removal from the mandrel 12, a mounting hub 48 is bonded to the radial end wall 36 of the torque tube 34. The preferred method of bonding is either laser or electron beam welding which will provide a secure drive connection between the mounting hub 48 and the torque tube 34. The mounting hub 48 has a formed inner surface which permits the installation of bushings or other rotary support members which might be desirable for use in the transmission assembly. As a general rule, the mounting hub 48 will also provide a surface on which a piston may be guided for sliding within the torque tube 34 and means for establishing the position of conventional return springs for use with the clutch assembly.

Figure 5:
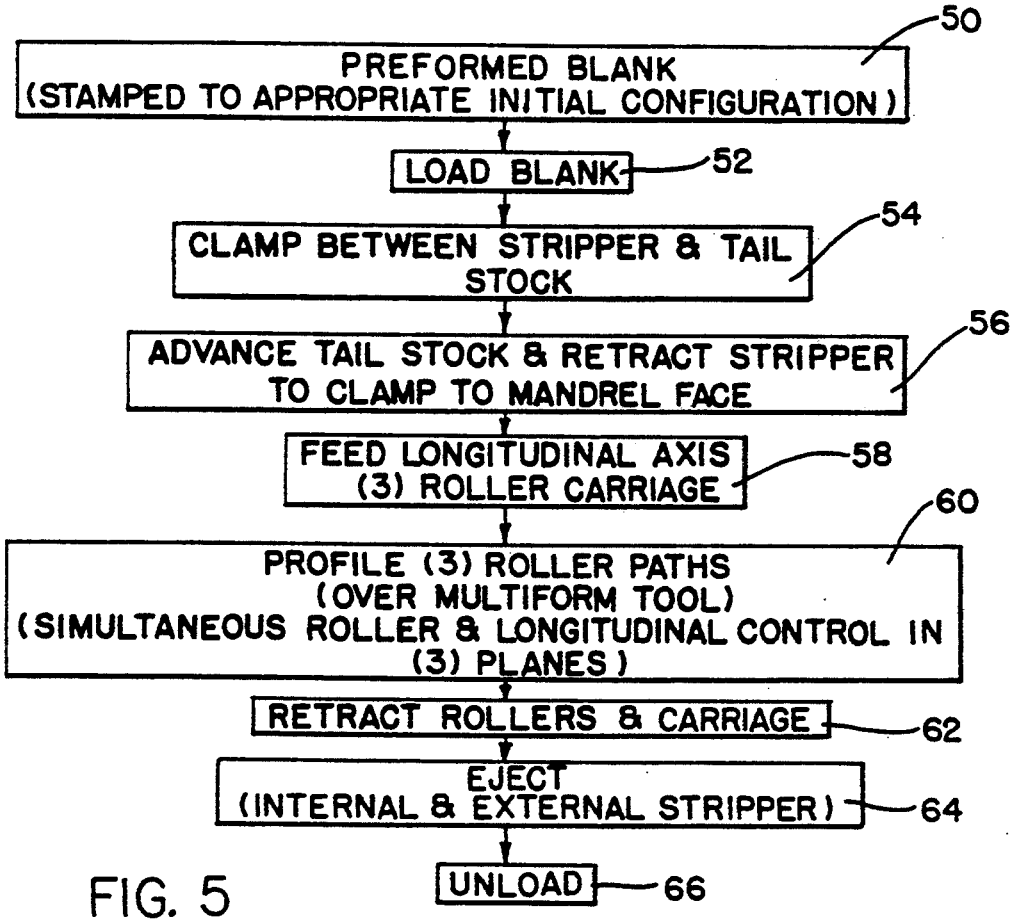
FIG. 5 is a flow diagram of the manufacturing process utilized to form the transmission housing.

FIG. 5 describes the method following in forming the torque tube 34 from the cup-shaped blank 18. While the FIGURE is substantially self-explanatory, it will be described briefly. The initial operation 50 is accomplished by stamping a blank member from a continuous sheet of steel to form the blank 18. After forming of the blank 18 in a stamping process or forging process, the blank 18 is loaded onto the head stock or mandrel 12 at operation 52, and at operation 54, the blank 18 is clamped between a conventional stripper in the tail stock 16.

A mandrel or flow forming process, such as that shown in FIGS. 1 and 2, has a stripper which is essentially a ram disposed central of the mandrel to urge the blank off of the mandrel following the rolling process. The stripper actuation is well known and it is not believed that a more detailed description is required at this point.

At operation 56, the tail stock and clamp are moved forward to provide direct connection between the mandrel 12 and the blank 18, and the stripper is retracted within the mandrel at this time. As seen in operation 58, the forming rollers 14 are advanced parallel to the longitudinal axis of the mandrel 12. As a general rule, three equiangularly spaced rollers are utilized. The rollers are mounted on a movable carriage or head which is generally hydraulically actuated to provide the extension and linear actuation along the longitudinal axis of the mandrel 12.

As seen in operation 60, the profile of the roller pads is established, and again the carriage on which the rollers are mounted is adapted to permit the rollers to move radially in and out on the carriage in a well known manner to provide the changes of the outer surface of the torque transmitting tube 34.

Following the forming in operation 60, the rollers and carriage are retracted in operation 62, such that at operation 64 the torque transmitting tube 34 is ejected from the mandrel 12. This ejection is be accomplished by the internal stripper which was originally clamped between the tail stock and the blank 18, and by and external stripper (not shown) which is moved along the outer surface of the mandrel 12 to engage the axial end of the torque transmitting tube 34. The stripping is followed by an unloading operation 66 in which the formed torque transmitting tube 34 is moved to another operation or "work in process" storage.

Further machining is performed on the torque transmitting tube 34 by conventional tools wherein the groove 32 is machined into the torque transmitting tube 34 and the axial teeth 46 are machined into the torque transmitting tube 34. Both of these operations are conventional metal removing operations which are well known to those skilled in the art. In the alternative, the axial teeth 46 can be formed during the flow forming operation. Also following removal from the forming mandrel 12, the mounting hub 48 is secured in place, as described above. Thus, it is seen that a substantially intricate and complete torque transmitting tube is formed with a rolling process in a single pass on a flow forming machine.

The prior art mechanisms or torque tubes are split into two pieces at generally at the groove 32. They are constructed such that the torque tube portion 38 is separate from the spline portion 26. The spline portion 26 then must have formed on the outer surface thereof a toothed or other drive connection which will establish the relationship between the torque tube portion 38 and the spline portion 26. By permitting the entire torque tube to be manufactured in a single flow forming operation, the number of parts, inventory and assembly of the torque tube is greatly improved.

The spline portion 26, as best seen in FIGS. 2 and 3, has a smooth outer diameter 68 which is generally used as a brake surface upon which a brake bank can be selectably engaged to provide for retardation of the torque tube and the establishment of a reaction device within a conventional transmission.

The embodiments of the invention in which an exclusive property or privilege is claimed are defined as follows:

1. A method of manufacturing a torque transmitting housing, comprising the steps of:

providing a roller forming apparatus including at least one roller and a mandrel, the mandrel having a splined cylindrical portion of a first diameter, a smooth cylindrical portion of a second diameter greater than said first diameter, and a transition portion joining said splined cylindrical portion to said smooth cylindrical portion;

providing a cup shaped blank;

mounting said cup shaped blank on said mandrel adjacent said splined cylindrical portion; then rotating said at least one roller and said mandrel relative to each other about a longitudinal axis of said mandrel, while rotating said at least one roller about its longitudinal axis; then contacting said cup shaped blank with said at least one roller, while performing said rotating steps, and translating said at least one roller along said splined cylindrical portion with said at least one roller being radially spaced from said splined cylindrical portion a first distance, thereby forming said cup shaped blank into a first portion having a splined inner circumferential portion, a smooth outer circumferential portion, and a wall thickness corresponding to said first distance, while lengthening said cup shaped blank;

maintaining contact between said at least one roller and said cup shaped blank while continually performing said rotating steps, and translating said at least one roller along said transition portion while increasing the radial spacing between said at least one roller and said transition portion to a second distance greater than said first distance, thereby forming said cup shaped blank into a second portion contiguous the first portion, having a smooth outer circumferential portion and a gradually thickening wall portion corresponding to said second distance while continually lengthening said cup shaped blank;

maintaining contact between said at least one roller and said cup shaped blank while continually performing said rotation steps, and translating said at least one roller along pan of said smooth cylindrical portion with said at least one roller being radially spaced from said smooth cylindrical portion a third distance less than said first distance, thereby forming said cup shaped blank into a third portion, contiguous the second portion, having a smooth outer circumferential portion, a wall thickness corresponding to said third distance, and an outer diameter substantially equal to a terminus outer diameter of said second portion while continually lengthening said cup shaped blank;

maintaining contact between said at least one roller and said cup shaped blank while continually performing said rotating steps, and translating said at least one roller along a second pan of said smooth cylindrical portion while increasing the radial spacing between said at least one roller and said smooth cylindrical portion to a fourth distance, thereby forming said cup shaped blank into a fourth portion, contiguous said third portion, having a smooth outer circumferential portion and gradually thickening wall portion corresponding to said fourth distance, while continually lengthening said cup shaped blank; then removing said at least one roller from contact with said cup shaped blank;

removing the formed cup shaped blank from said mandrel; and forming axially extending drive tabs in said fourth portion.

2. A method of manufacturing a torque transmitting housing, comprising the steps of:

providing a roller forming apparatus including at least one roller and a mandrel, the mandrel having a splined cylindrical portion of a first diameter, a smooth cylindrical portion of a second diameter greater than said first diameter, and a transition portion joining said splined cylindrical portion to said smooth cylindrical portion;

providing a cup shaped blank;

mounting said cup shaped blank on said mandrel adjacent said splined cylindrical portion; then rotating said at least one roller and said mandrel relative to each other about a longitudinal axis of said mandrel, while rotating said at least one roller about its longitudinal axis; then contacting said cup shaped blank with said at least one roller, while performing said rotating steps, and translating said at least one roller along said splined cylindrical portion with said at least one roller being radially spaced from said splined cylindrical portion a first distance, thereby forming said cup shaped blank into a first portion having a splined inner circumferential portion, a smooth outer circumferential portion, and a wall thickness corresponding to said first distance, while lengthening said cup shaped blank;

maintaining contact between said at least one roller and said cup shaped blank while continually performing said rotating steps, and translating said at least one roller along said transition portion while increasing the radial spacing between said at least one roller and said transition portion to a second distance greater than said first distance, thereby forming said cup shaped blank into a second portion contiguous the first portion, having a smooth outer circumferential portion and a gradually thickening wall portion corresponding to said second distance while continually lengthening said cup shaped blank;

maintaining contact between said at least one roller and said cup shaped blank while continually performing said rotation steps, and translating said at least one roller along part of said smooth cylindrical portion with said at least one roller being radially spaced from said smooth cylindrical portion a third distance less than said first distance, thereby forming said cup shaped blank into a third portion, contiguous the second portion, having a smooth outer circumferential portion, a wall thickness corresponding to said third distance, and an outer diameter substantially equal to a terminus outer diameter of said second portion while continually lengthening said cup shaped blank;

maintaining contact between said at least one roller and said cup shaped blank while continually performing said rotating steps, and translating said at least one roller along a second part of said smooth cylindrical portion while increasing the radial spacing between said at least one roller and said smooth cylindrical portion to a fourth distance, thereby forming said cup shaped blank into a fourth portion, contiguous said third portion, having a smooth outer circumferential portion and gradually thickening wall portion corresponding to said fourth distance, while continually lengthening said cup shaped blank; then forming axially extending drive tabs in said fourth portion;

removing said at least one roller from contact with said cup shaped blank; and removing the formed cup shaped blank from said mandrel.

* * * * *